US005240563A

United States Patent [19]

Karvinen et al.

[11] Patent Number: 5,240,563

[45] Date of Patent: Aug. 31, 1993

[54] COMPACT PRESS SECTION WITH CLOSED DRAW OF THE WEB IN A PAPER MACHINE

[75] Inventors: Mikko Karvinen, Vihtavuori; Reima Kerttula, Muurame; Jorma Laapotti, Palokka; Juhani Pajula, Jyväskylä, all of Finland

[73] Assignee: Valmet Paper Machinery Inc., Finland

[21] Appl. No.: 829,989

[22] Filed: Feb. 3, 1992

[30] Foreign Application Priority Data

Dec. 19, 1991 [FI] Finland ..... 916026

[51] Int. Cl.[5] ..... D21F 3/04

[52] U.S. Cl. ..... 162/274; 162/275; 162/358.2; 162/360.3; 162/359.1

[58] Field of Search ..... 162/358, 359, 360.1, 162/274, 275, 358.1, 358.2, 359.1, 360.3

[56] References Cited

U.S. PATENT DOCUMENTS

| | | | |
|---|---|---|---|
| 3,185,617 | 5/1965 | Justus | 162/274 |
| 3,285,806 | 11/1966 | Justus et al. | 162/360.1 |
| 4,359,827 | 11/1982 | Thomas | 162/359 |
| 4,483,745 | 11/1984 | Wicks et al. | 162/358 |
| 4,526,655 | 7/1985 | Karvinen et al. | 162/360.1 |
| 4,648,942 | 3/1987 | Wanke et al. | 162/359 |
| 4,889,598 | 12/1989 | Niskanen | 162/206 |
| 4,919,762 | 4/1990 | Laapotti | 162/360.1 |
| 4,976,821 | 11/1990 | Laapotti | 162/360.1 |
| 5,037,509 | 8/1991 | Wedel | 162/286 |
| 5,049,239 | 9/1991 | Autio | 162/360.1 |

FOREIGN PATENT DOCUMENTS

| | | | |
|---|---|---|---|
| 885737 | 6/1990 | Finland . | |
| 0697774 | 9/1953 | United Kingdom | 162/360.1 |

*Primary Examiner*—Karen M. Hastings
*Attorney, Agent, or Firm*—Steinberg & Raskin

[57] ABSTRACT

Closed press section in a paper machine, comprising a compact combination of press rolls. Certain of rolls define press nips with each other, between which nips the web has a closed draw supported by the face of a fabric. The press section has a center roll in connection with which a press nip or press nips are provided. A closed loop of a transfer band is passed around the center roll. The web is transferred on an outer face of the transfer band after the last press nip in the compact combination of rolls as a closed and constantly supported draw onto a drying wire in a drying section following after the press section. The transfer band loop is made of a transfer band fabric that substantially does not receive water and does not rewet the web. The web-adhesion properties of the outer face of the transfer band fabric are chosen so that, after the last nip, the web follows the transfer band fabric, and so that the web can be transferred as a fully closed draw onto the drying wire. In connection with the loop of the transfer band fabric, means for conditioning of the band and/or safety devices are provided, by whose means an adequate operation of the transfer band fabric is maintained.

20 Claims, 3 Drawing Sheets

COMPACT PRESS SECTION WITH CLOSED DRAW OF THE WEB IN A PAPER MACHINE

BACKGROUND OF THE INVENTION

The invention is related to a closed press section in a paper machine, comprising a compact combination of press rolls in which the rolls form press nips with each other, between which nips the web has a closed draw supported by the face of a fabric, and comprising a center roll, in connection with which a press nip or press nips are formed and around which center roll a closed loop of a transfer band is passed, in whose outer face the web is transferred, after the last press nip in the compact combination of rolls, as a closed and constantly supported draw onto the drying wire or an equivalent fabric in the drying section following after the press section.

A problematic point in the prior art pres sections in paper machines is formed by the part in which the web that has passed through the nips in the press section is detached from a smooth-faced roll in the press, in particular from the center roll, being transferred to the drying section of the paper machine. This problem is accentuated with increasing running speeds of paper machines and/or when the paper web is very weak, e.g. when a maximal bulk is aimed at. In such a case, the pressing is carried out with very low nip loads, and the wet strength of the web remains low. The problem arises from the circumstance that, when the web is being pulled apart from the smooth-faced roll, a high tensile strain is applied to the web and that, when the web is being transferred from the press section to the drying section, it must run a short distance as a free and unsupported draw so that it is not supported by a roll face or by a fabric. When the running speed of the machine is increased, in such a case there is a high risk that the paper web is torn in said area. In conventional solutions, the web should preferably be detached from the center roll of the press section so that it runs to the drying section as straight as possible. Owing to the above, said area of transfer from the press section to the drying section has constituted a significant bottleneck in increasing the speed of a paper machine.

In prior art, attempts have been made to solve the problem discussed above, e.g., by means of the press sections described in U.S. Pat. Nos. 4,359,827 and 4,359,828, in which the web is not placed in direct contact with the face of the center roll in the press section, but a porous belt is fitted around the center roll, which belt corresponds to the length of the roll, i.e. to the working width of the machine, and which belt, guided by guide rolls, supports the web on said run of transfer from the press section to the drying section. However, it is a substantial drawback of the solutions of said U.S. patents that the porous band employed in these solutions loses some of its porosity in the nips in the press section, in which it is compressed to some extent. It is a second substantial drawback in these solutions that, at high temperatures, said band may lose most of its porosity, and in some extreme cases it may even melt.

As is known in prior art, attempts are made to employ high temperatures in the press section to intensify the dewatering. It is a further drawback in the solutions of said U.S. patents that the possibility of cleaning of the porous belt is very poor. In the nips in the press section, the pores in the belt tend to be blocked, and the U.S. patents do not suggest any means for conditioning and cleaning of the band.

In the assignee's FI patent application No. 885737 (filed Dec. 9, 1988), attempts have been made to provide a solution by whose means the drawbacks described above are avoided and an increased running speed of a paper machine is permitted and a problem-free transfer of the web from the press section to the drying section is ensured. In view of achieving the above, in said FI application, an endless metal band is passed over the center roll, which band is formed as a closed loop by means of guide and tensioning rolls, which loop is passed from the center roll to the beginning of the drying section, the web being arranged to be transferred from the pres section to the drying section as supported by said loop.

There is general aim to improve the dewatering capacity of presses in the press section of a paper machine. If the moisture content of a paper web can already be minimized in the press section, this amounts to considerable economies in the costs of paper manufacture, for the less wet the paper web is when it arrives from the press section, the lower is the consumption of energy in the drying section. It can be considered a rule of thumb that, if the moisture content of the web in the press section can be made lower by one percentage unit, the consumption of energy in the drying section is about four per cent lower, which means considerable economies in cost. The dewatering capacity is, as a rule, improved by raising the pressing temperature of the paper web.

In the constructions employed commonly in prior art, the center roll in the press constitutes an object of development. This is because of the material of the center roll, which is commonly some suitable rock, for example granite. It is, however, well known that rock rolls are quite sensitive to extensive and sudden changes in temperature, and the effects of such changes may be quite fatal. Attempts have been made to develop suitable substitutes for granite rolls. It is, however, difficult to make a suitable face for a center roll, and, moreover, the making of the face restricts the choice of the material for the rest of the roll. Also, different paper qualities require a different coating and frequently also a different process for the manufacture of the roll coating. Often it is necessary to manufacture different paper qualities out of different raw materials by means of the same paper machine. A change in quality would also require change of center roll or at least of its coating. A center roll is, however, an expensive and heavy component, and its replacement requires a long and costly standstill of the paper machine. If a center roll is provided, e.g., with a welded coating or if the coating is elastic, such as rubber-like, the device intended for heating of the paper web must necessarily be placed above the web if it is desirable to provide such a heating device in the construction before the third press nip. However, in a press, before the third press nip, there is a very scarce space available for an efficient device that raises the temperature of the web and regulates the temperature profile. However, it is a drawback of a heater placed in said location that it causes gathering of contaminations and their falling down onto the paper web.

An attempt has been made partly to solve the problems discussed above by means of the method and the device described in the applicant's FI patent application No. 891343 (filed Mar. 21, 1989). In said method, it has been considered novel that a transfer band, which has been formed as an endless loop by means of tension and guide rolls, is passed over the center roll in the press section, which transfer band extends to outside the area of the press rolls and onto which transfer band the paper web is transferred to run, and that the paper web is heated in the area of said loop outside the press rolls.

The device in accordance with the FI patent application No. 891343 does, however, not solve the problems discussed above and related to the detaching of the paper web from the face of the center roll and to its further transfer.

Thus, it is a general object of the present invention to provide a compact press section in a paper machine in which, at the same time, at least the most important ones of the problems discussed above are solved, together with some other problems, which will be dealt with in the following.

How to keep the smooth face of the center roll in a press section clean has become a problem in particular with fine papers. Further, a need has occurred to control and to regulate the length in the machine direction of the press zone in the roll nips formed in connection with the center rolls. This object cannot be achieved at all by means of a metal band running around the center roll (said FI patent application No. 885737).

One difficult problem, which was mentioned above preliminarily, arises from the fact that different paper qualities are often manufactured by means of the same paper machine, for example, depending on the market situation, the orders, or on the raw material that is available. The center rolls currently in operation and the belt solutions related to them have, however, not permitted a rapid and smooth change of quality. The change of quality ought to take place quite rapidly, because a standstill time causes considerable economic losses. Nor has consideration been given to quick replacement of the belt running around the center roll or of the other press fabrics and press rolls in the prior-art solutions. In the prior-art center-roll/transfer-belt arrangements, particular attention has not been paid to conditioning of the transfer belt running around the center roll or in other respects to safety and optimization of the transfer of the web taking place on said belt.

OBJECTS AND SUMMARY OF THE INVENTION

In view of achieving the objectives stated above and those that will come out later, and others, in the present invention, said transfer band is a transfer band fabric that substantially does not receive water and does not rewet the web, the web-adhesion properties of the outer face of said transfer band fabric have been chosen so that, after said last nip, the web follows the transfer band fabric, and so that the web can be transferred as a fully closed draw onto the drying wire or onto an equivalent fabric that carries the web further. Further, in the present invention, in connection with the loop of said transfer band fabric, means for conditioning of the band and/or safety devices are provided, by whose means an adequate operation of the transfer band fabric is maintained.

In a press section in accordance with the invention, as said transfer band, expressly a transfer band fabric is used that does substantially not receive water, so that the web is not rewetted when it is transferred on the outer face of the transfer band fabric between the nips and from the last nip onto the drying wire or equivalent. The transfer band fabric is preferably made as a multilayer structure so that the choice of the material for its outer face provides suitable properties of adhesion to the web so that the web can be made to follow the transfer band fabric after the last press nip but, on the other hand, to be detached from the band in the transfer zone without problems and to be transferred onto the drying wire, e.g., as a suction-roll transfer. The structure and the materials of the transfer band fabric are chosen while also taking into account the properties of cleaning, conditioning, the mechanical strength properties, and the elastic properties of the band.

By means of the choice of the thickness and the elasticity of the transfer band fabric, it is also possible to control the length in the machine direction of the nip zones in the roll nips formed in connection with the center rolls and, thereby, the process of pressing in said nips.

It is an important aspect of the invention that a relatively inexpensive transfer band fabric also operates a the wearing replacement part which protects the expensive and heavy center roll. In the invention, the center roll can be manufactured irrespective of its coating, with consideration to the mechanical aspects alone. The transfer-band fabric loop can be arranged as quickly replaceable, e.g., in connection with change of paper quality. For each paper quality to be manufactured, it is possible to design and to store exactly the particular sort of transfer band loop that is best suitable for the quality concerned in view of its properties of adhesion, dewatering, etc.

The invention is also related to the frame construction of a press section, which is preferably arranged so that the center roll is mounted, preferably by means of fixed bearing supports, on an intermediate frame part or on the front or rear frame, which is cantilevered in respect of this part and provided with detachable intermediate pieces placed in the side frames at the operating side,the transfer-band fabric loop being quickly replaceable after opening of said intermediate pieces.

Moreover, in the press section, quick replacement of press rolls and of the other fabrics can be arranged favorably by lifting the press rolls straight upwards, e.g., by means of a crane mounted on the ceiling, without difficult operations of shifting to the side, by making the frame part open at the top and partly openable at the top by shifting the press rolls from above the center roll to the side by means of intermediate frame parts.

In the invention, it is preferable to provide the transfer fabric loop with a cleaning and safety arrangement, by whose means it is possible to prevent running of the web around the transfer belt loop as a result of an unsuccessful web transfer, which running would form a web layer that destroys the fabrics on the face of the transfer belt loop.

In the invention, the transfer belt fabric may be impermeable or permeable to some extent. When a permeable transfer belt fabric is used, it is preferable to use a hollow-faced center roll, whereas in connection with an impermeable belt it is possible to use a smooth-faced center roll, such as a roll with a cast-iron body.

BRIEF DESCRIPTION OF THE DRAWINGS

In the following, the invention will be described in detail with reference to some exemplifying embodiments of the invention shown in the figures in the accompanying drawing, the invention being in no way strictly confined to the details of said embodiments.

FIG. 3A shows a hollow-faced roll as the center roll of the press,

FIG. 3B shows a variation in which the pick-up felt operates as the press felt in all of the three subsequent press nips in the press section, FIGS. 3C, 3D and 3F show different variations of the accomplishment of the closed draw of the web by means of a transfer fabric in accordance with the invention and a suction-transfer roll onto the drying wire of the drying section, FIG. 3G shows different safety and conditioning arrangements for the transfer fabric loop in accordance with the invention, and FIG. 3H shows arrangements of cleaning and heating of the transfer fabric loop in accordance with the invention.

DETAILED DESCRIPTION

Figure 1:
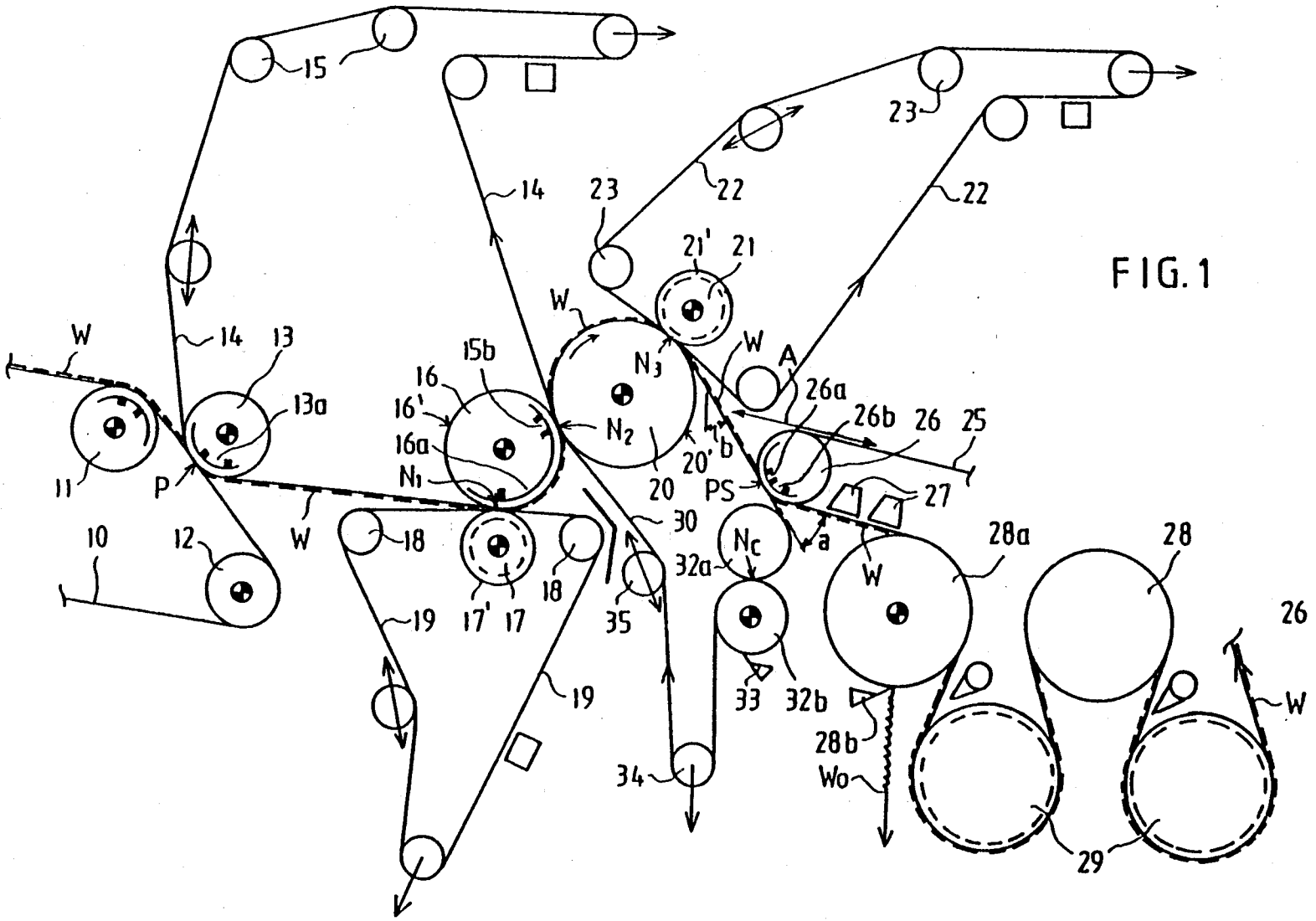
FIG. 1 is a schematic side view of a preferred embodiment of a press in accordance with the invention.

FIG. 1 is a schematic side view of a preferred press section in accordance with the invention, whose basic construction is the assignee's Sym-Press-II TM press section. The paper web W is drained on the forming wire 10. The web W is transferred at the pick-up point P on the forming wire 10 between the suction roll 11 and the drive roll 12 onto the pick-up fabric 14 with the aid of the negative pressure in the suction zone 13*a* of the pick-up roll 13.

The web W is transferred on the lower face of the pick-up felt 14 into the first dewatering press nip $N_1$. This nip $N_1$ is a two-felt nip, being formed between a lower, hollow-faced 17' press roll 17 and an upper suction roll 16. Through the nip $N_1$, the lower felt 19 runs, which removes water and is guided by the guide rolls 18. After the nip $N_1$, with the aid of the negative pressure effective through the perforations 16' in the suction zone 16*a* of the suction roll 16, the web W follows the pick-up felt 14 and is transferred on its face into the second press nip $N_2$, in which the pick-up felt 14 acts as a press fabric that receives water. In the area of the second nip $N_2$, the suction roll 16 has a second suction zone 15*b*, after which after which the web W follows the face of the transfer belt fabric 30, which is fitted in accordance with the invention and runs around the center roll 20 in the press, which fabric 30 has such properties of adhesion to the web that the web is detached from the face of the pick-up felt 14 after the nip $N_2$ and follows the face of said transfer belt fabric 30, on which face the web W is transferred into the third press nip $N_3$. In the transverse direction, the transfer belt fabric 30 extends substantially over the entire length of the center roll 20 and slightly beyond the web W width.

The nip $N_3$ is formed between the center roll 20 and the hollow-faced 21' press roll 21. The press felt 22, guided by the guide rolls 23, runs through the nip $N_3$. After the nip $N_3$, the web W follows the outer face of said transfer belt fabric 30, which face is more adhesive to the web W than the face of the press felt 22. On the downwards inclined straight run of the fabric 30, the web W is transferred, without substantial rewetting and as a fully closed and constantly supported draw, onto the drying wire 25 in the drying section. The transfer belt fabric 30 and the transfer suction roll 26 form a transfer zone PS, in whose area the web W is transferred onto the drying wire 25. This transfer is aided by the first suction zone 26*a* of the transfer suction roll 26, in which zone the negative pressure is higher than in the subsequent second suction zone 26*b*, which ensures that the web W remains on the face of the drying wire 25. The web W is kept on the straight run of the drying wire 25 after the transfer suction roll 26 on the lower face of the drying wire 25 with the aid of the field of negative pressure produced by the suction boxes 27, being transferred onto the first heated drying cylinder 28*a*. From the drying cylinder 28*a*, the web W follows the drying wire 25 over the suction cylinders 29 and continues further as a single-wire draw through the first drying group in the drying section.

After the transfer zone PS, the transfer belt fabric runs through the safety and conditioning nip $N_c$ formed by the rolls 32*a* and 32*b*. Of said rolls, the lower one 32*b* is provided with a drive gear, and on its lower face there is a doctor 33, which keeps the face of the roll 32*b* clean. The operation of the nip $N_c$ will be reverted to later in more detail in connection with the description related to FIG. 3G. After the roll 32*b*, the run of the transfer belt fabric 30 continues to a tensioning roll 34, which turns the run of the transfer belt loop upwards to the guide roll 35 and from it further as a straight run into the second nip $N_2$.

Figure 2:
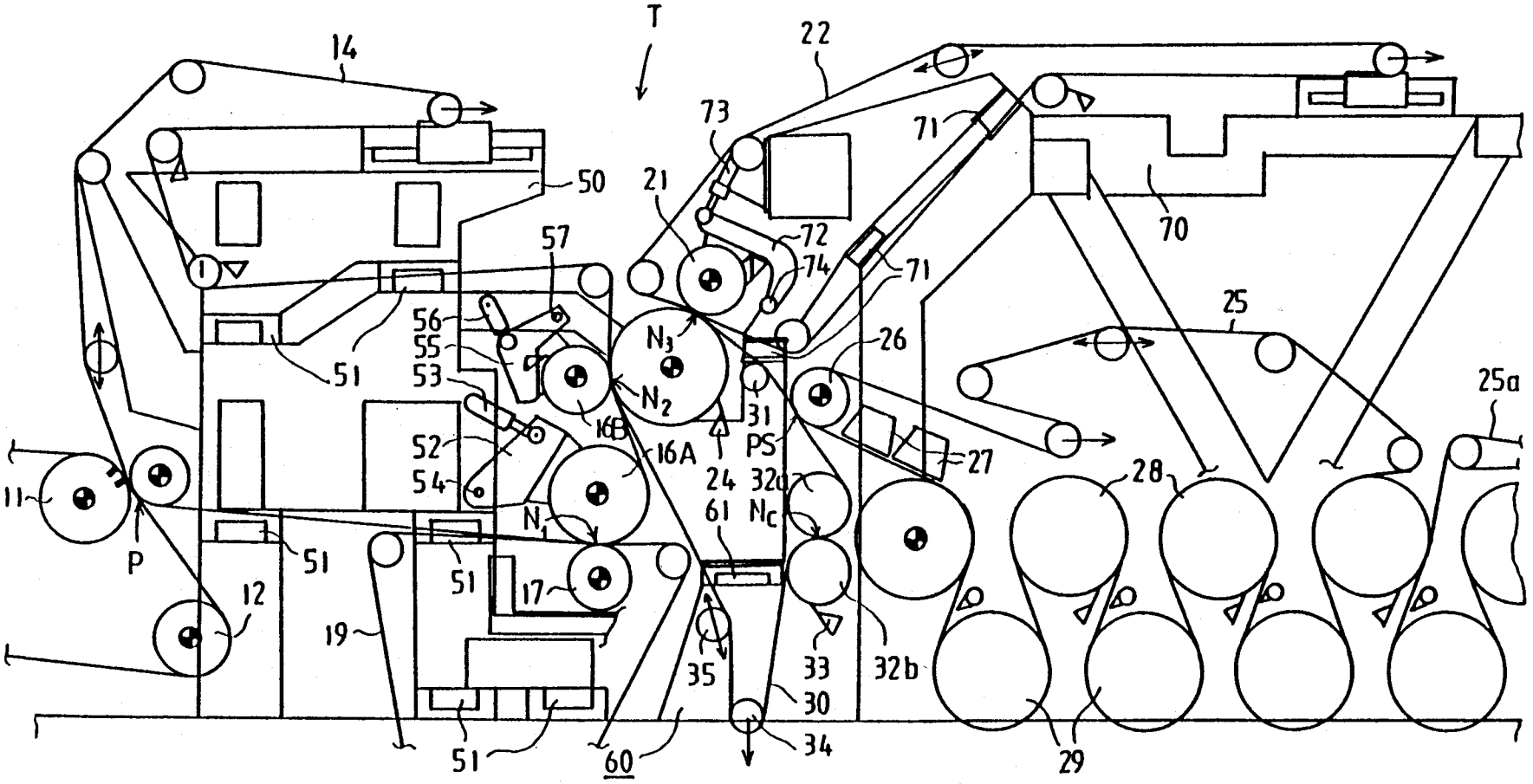
FIG. 2 shows a second version of the invention. Further, in FIG. 2, the frame constructions of the press section, which are related to the present invention, are also shown schematically.

FIG. 2 shows an application of the invention to the applicant's Sym-Press-O TM press section. Further, FIG. 2 also shows the frame constructions of the press section, because they are in certain respects related to the inventive idea of the present invention. In the following, those features of construction of a press section as shown in FIG. 2 will be described that differ from that described above in respect of FIG. 1.

According to FIG. 2, the first nip $N_1$ is formed between a lower roll 17 and an upper press-suction roll 16A. The press roll 16A does not form a press nip with the center roll 20, but the web W is transferred from the suction zone of the roll 16A on the pick-up fabric 16 as an upwards directed straight run into the second nip $N_2$, which is formed between the center roll 20 and a hollow-faced press roll 16B.

Differing from FIG. 1, after the third nip $N_3$, the run of the transfer belt fabric 30 is guided by a guide roll 31, after which the web W is transferred on the transfer zone PS, where the web W is transferred onto the drying wire 25.

According to FIG. 2, there is a cleaning doctor on the lower sector of the center roll 20 that is free from the fabric loop 30. A press section as shown in FIG. 2 is advantageous especially when it is necessary to regulate the nip loads within wide limits, because in all the nips $N_1$, $N_2$ and $N_3$, it is possible to employ variable-crown rolls 17:16*b* and 21.

In the following, the press frame construction shown in FIG. 2 will be described in the respects in which it is related to the present invention. The press section comprises a front frame 50 and a rear frame 70, between which there is a space T, which is open at the top or which can be opened quickly and through which space the press rolls in the compact combination of rolls as well as the upper fabrics 15 and 22 can be replaced quickly without disassembly of the frame parts. The press roll 16B, which forms the second nip $N_2$, is mounted on loading arms 55, which are attached to the front frame 50 by means of horizontal articulated joints 57 to be pivoted by means of a power unit 56 for the purpose of loading and opening of the second nip $N_2$ so that a space is opened above the lower press roll 16A and the center roll 20 for their replacement. This replacement takes place upwards through the open or opened space T by means of a crane mounted on the ceiling.

In a corresponding way, the press roll 21 is mounted on loading levers 72, which are attached by means of horizontal articulated joints 74 to the front part of the rear frame 70 to be pivoted by means of a power unit 73 for the purpose of loading the nip $N_3$ as well as for shifting the roll 21 aside for replacement of the press rolls placed underneath, which is also carried out through the space T by lifting substantially straight upwards by means of the crane mounted on the ceiling.

The center roll 20 is mounted by means of fixed bearing supports on an intermediate frame 60, which is attached to the rear frame 70 by means of intermediate pieces 71. In accordance with the present invention, the top portion of the intermediate frame 60 is cantilevered and provided with intermediate pieces 61 and 71 for quick replacement of the transfer-belt fabric loop 30, for example when the paper quality manufactured by means of the paper machine is changed and when the transfer belt fabric 30 is also replaced to comply with the new quality or when a worn transfer belt fabric 30 or fabrics is/are replaced. The intermediate frame 60 may also be a part of the front or rear frame 50;70.

Both the front frame 50 and the rear frame 70 are also cantilevered in a way in itself known and provided with openable intermediate pieces 51,71 placed at the operating side of their side frames for the purpose of replacement of the upper fabrics 15 and 22.

For replacement of the lower fabric 19 of the first nip $N_1$, the lower part of the front frame 50 is also provided with openable intermediate pieces 51.

FIG. 2 also shows a part of the frame construction of the drying section as well as an initial portion of the second drying wire 25A provided with single-wire draw.

The transfer-band fabric loop 30 extends across the entire width of the web W in the transverse direction. The adhesiveness of the outer face of the transfer band fabric 30 to the web W is chosen so that, after the last nip $N_3$, the web W follows the transfer band fabric 30 without rewetting, but also so that the detaching in the transfer zone PS can be accomplished without disturbance. The transfer band fabric 30 preferably has a multi-layer structure, for example such that it includes a net-like or fibrous fabric, into which an outer-surface layer of suitable adhesiveness and the other layers have been impregnated by mean of suitable plastic materials.

The thickness of the transfer band fabric 30 is, e.g., in the range of from about 1.5 to about 8 mm. The hardness of the outer face of the transfer band fabric 30 is, e.g., in the range of from about 1 to about 100 P&J. The thickness and the resilience of the transfer band fabric 30 are chosen so that the length in the machine direction of the nip zones in the nips $N_2$ and $N_3$ through which the transfer band fabric 30 runs is in the range from about 25 to about 70 mm when the linear load in said nips $N_2$ and $N_3$ is in the range from about 10 kN/m to about 200 kN/m.

The transfer band fabric 30 is preferably made as a joint-free closed loop, in which case it must be replaced by opening the intermediate piece 61 and 71, and the frame part 60,70 must be cantilevered. The transfer band fabric 30 may also be made so that it has a joint, in which case the intermediate pieces in the intermediate frame 60 and the cantilevering are unnecessary.

The run of the transfer band fabric 30 from the last nip $N_3$ is preferably such that the straight run of the transfer band fabric 30 or the run guided by the guide roll 31 is at an angle b downwards in relation to the vertical plane. Said angle b is preferably chosen within the range of b=from about 10° to about 50°. In order that the transfer onto the drying wire 25 or an equivalent transfer fabric in the transfer zone PS should be free of problems even at high speeds, the angle a of change in the direction of the web W in said transfer zone PS is arranged as little as possible. As a rule, the angle $a<60°$. Most appropriately, the angle a is chosen in the range of a=from about 2 to about 50°.

In a press section in accordance with the invention, the threading of the web W takes place preferably so that the web W is first passed as of full width down from the first drying cylinder **28*a*, from whose lower face the web W is detached by means of a doctor 28*b*, being transferred into the pulp in the direction of the arrow $W_0$. Hereupon, in the area of the wire part of the press section 28**, from a web W of full width, a narrow leader is cut, which is threaded in a way in itself known through the drying section, whereupon the web W is widened to full width.

In the following ,with reference to FIGS. 3A to 3H, different variations will be described for various component fields of the invention. According to FIG. 3A, the center roll 20A is a hollow-faced **20*a* roll, around which a transfer belt fabric 30 runs which is arranged in accordance with the invention. In this embodiment, the transfer belt fabric 30 is to some extent permeable to water, and it is in contact with the water-receiving hollow face 20*a* of the center roll 20A. On the sector of the center roll 20A that is free from the belt 30', there is a trough 36 for gathering of water and contaminations. The roll face 20*a* is kept clean by a cleaning doctor 24**.

Figure 3A:
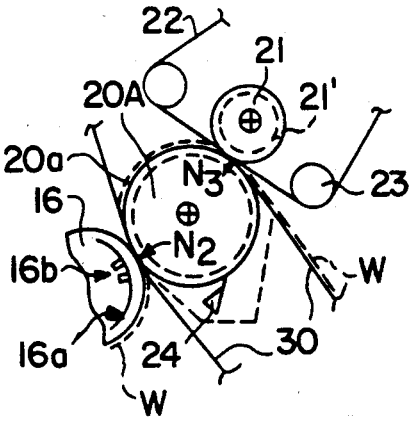
FIGS. 3A to 3H show different variations for various details of the press sections as shown in FIGS. 1 and 2 as follows.
Figure 3B:
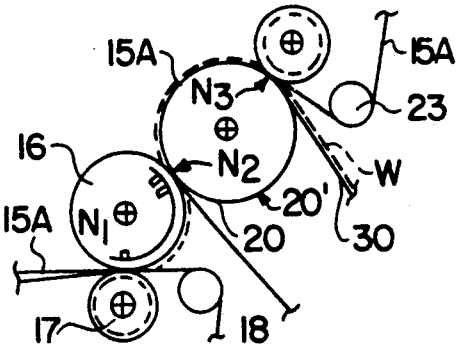
Figure 3C:
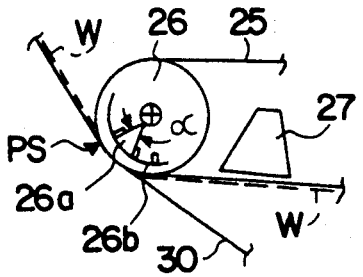

According to FIG. 3B, the pick-up felt 15A runs through all of the three subsequent press nips $N_1$,$N_2$ and $N_3$ and operates in them as a press fabric that received water. This construction provides the advantage that, between the nips $N_2$ and $N_3$, the pick-up felt 15A presses the web W against the outer face of the belt 30, in which case separation of the web W from the face of the belt 30 between the nips $N_2$ and $N_3$ is prevented even with a very little adhesion. The arrangement shown in FIG. 3B can also be applied in a press of the Sym-Press-O TM type shown in FIG. 2.

FIGS. 3C, 3D, 3E and 3F show some alternative solutions, by whose means it is ensured that the web W can be detached reliably from the outer face of the transfer belt fabric 30 to be transferred onto the drying wire 25. According to FIG. 3C, the transfer suction roll 26 has a transfer zone PS between the wire 25 and the fabric 30 on the suction zone **26*a* of the suction roll 26. The magnitude $\alpha$ of said zone is preferably arranged adjustable in the range of $\alpha=0°-45°$, preferably in the range of $\alpha$=from about 5° to about 20°. By means of regulation of the angle $\alpha$, it is partly possible to optimize the transfer of the web. In the first zone 26*a* in the suction roll, there is a negative pressure, which is, as a rule, at the level of from about 0.1 to about 0.7 bar. In the next zone 26b**, there is a lower negative pressure that ensures the transfer, said negative pressure being, as a rule, in the range of from about 0.05 to about 0.4 bar.

Figure 3D:
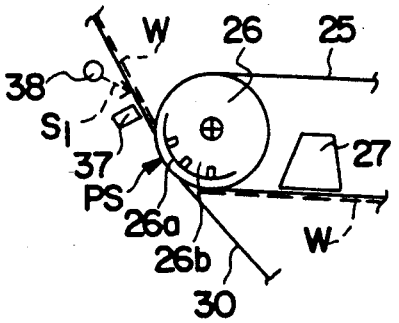

According to FIG. 3D, before the transfer zone, a bending shoe (e.g., a guide shoe) 37 is placed against the inner face of the transfer belt fabric, which shoe 37 is preceded by water jet means 38, the area between the inner face of the transfer fabric 30 and the curved guide face of the bending shoe 37 being lubricated by means of the water jets $S_1$ applied from said water jet means 38. Owing to the guide face of the shoe 37, detaching forces, which arise from a slight difference in velocity, are produced between the outer face of the transfer fabric 30 and the web W.

In connection with, or instead of, the shoe 37, it is possible to employ ultrasonic oscillators, by means of whose energy impulses the contact between the web W and the outer face of the belt 30 is shaken to make it more favorable for the transfer onto the drying wire 25.

Figure 3E:
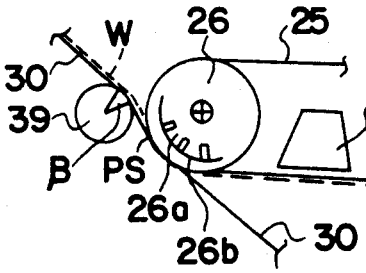
Figure 3F:
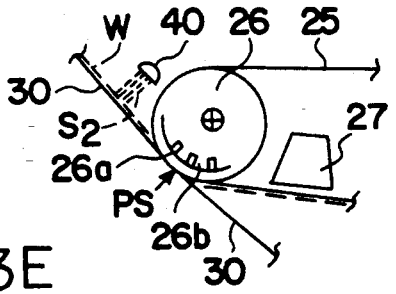

According to FIG. 3E, the bending shoe 37 as shown in FIG. 3D is substituted for by a corresponding revolving guide roll 39, by means of whose sector $\beta$ an effect is produced that corresponds to that produced by the bending shoe 37. According to FIG. 3F, before the transfer zone PS of the transfer suction roll 26 at the proximity of the web W, an infrared heater 40 is fitted, by means of whose radiation $S_2$ especially the temperature of the water present in the web W is raised, whereby the separation of the web from the outer face of the transfer belt fabric 30 is promoted.

Figure 3G:
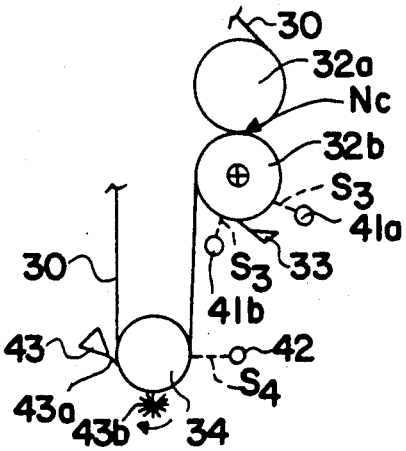

FIG. 3G shows a safety and/or cleaning nip $N_c$ operating on the loop of the transfer belt fabric 30 and formed between the rolls 32a and 32b. The lower roll 2b is provided with a drive gear, and the properties of its surface are chosen so that, should the web W follow the face of the transfer belt fabric 30, it adheres to the roll face 32b, from which it is detached by means of the doctor 33 and transferred into the pulpar placed underneath. The cleaning roll 32b has a considerable sector of contact with the transfer fabric 30. The bending of the transfer band fabric in opposite directions with relatively short curve radii, taking place on the rolls 32a and 32b, promotes the cleaning quality of the transfer band fabric 30 considerably. Moreover, the face of the roll 32b is chosen such that impurities adhere to this face, from which they are detached and washed by means of water jets and/or chemical jets $S_3$ applied from the jet pipes 31a and 31b. The lower roll 32b is preferably a roll provided with a smooth face that makes the web adhere to the roll, for example a rubber-faced, a Dynarock TM -faced or a Mikrorock TM -faced roll. The nip load in the nip $N_c$ is preferably in the range of from about 5 to about 30 kN/m. The safety function of the nip $N_c$ is of particular importance with certain pulp raw-materials which are even highly contaminating.

Figure 3H:
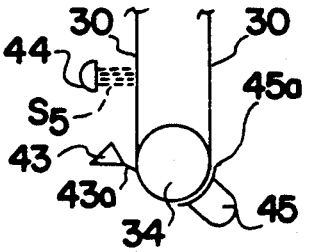

According to FIG. 3H, the transfer band fabric 30 is heated at the level of the tensioning roll 34 by means of steam jets applied from the steam box 45 into the treatment gap 45a. Moreover, according to FIG. 3H, the fabric 30 is heated by means of radiation $S_5$ applied from an infrared radiator 44. In this way, the temperature level of the fabric loop 30 is raised, the cleaning is intensified, and thermal energy is transferred by the intermediate of the fabric 30 is to act in the press nips $N_2$ and $N_3$ to promote the dewatering of the web W by means of mechanisms known per se.

In respect of the detail of the structure and properties of the transfer band fabric 30 is accordance with the invention, reference is made to the applicant's FI patent application Nos. 823187 and 842114, in which various belt-like transfer fabrics are described, which can be applied as a transfer band fabric 30 in the present invention, at least after certain modifications.

If necessary, the press sections in accordance with FIGS. 1 and 2 may also be employed as conventional press sections with open draw when the running speed of the paper machine and/or the strength of the paper web do not require a closed draw. The conversion to conventional press sections is carried out by removing the transfer belt 30 and by shifting either the transfer suction roll 26 alone (arrow A) or the transfer suction roll 26 and the suction boxes 27 to the optimal distance (e.g., 20–120 mm) from the center roll 20 that is required by an open draw of the paper web W. Such a shifting can be carried out, e.g., by means of hydraulic or pneumatic cylinders.

In the following, the patent claims will be given, and the various details of the invention may show variation within the scope of the invention idea defined in said claims and differ from the details described above by way of example alone.

What is claimed is:

1. A closed press section in a paper machine, comprising a compact combination of press rolls defining press nips with each other, one of said press rolls being a center roll, a plurality of fabrics supporting a web, one of said fabrics comprising a transfer band defining a closed loop around said center roll, said transfer band having an outer face upon which the web is transferred, at least a last one of said press nips being defined between said center roll and another one of said press rolls, a closed loop of said transfer band being passed around said center roll, said transfer band defining a closed draw located after said last press nip in said compact combination of rolls, the web being constantly supported in said closed draw, said transfer band comprising a fabric which substantially does not receive water such that said transfer band does not rewet the web, said outer face of said transfer band fabric having web-adhesion properties such that, after said last nip, the web follows the transfer band fabric in a straight run and is transferred in a transfer zone as a fully closed draw onto a drying wire or onto an equivalent fabric that carries the web further into a drying section following said press section, a suction roll located after said center roll in the running direction of the web, deflecting means comprising a guide shoe or a guide roll placed against the transfer band fabric and located in said straight run in proximity to said suction roll, the web being deflected by said deflecting means in conjunction with said suction roll and being detached from said transfer band fabric in said transfer zone in proximity to said suction roll, and means for conditioning said transfer band loop, said means structured and arranged to maintain an adequate operation of said transfer band fabric.

2. The press section of claim 1, further comprising an intermediate frame, said center roll being mounted on said intermediate frame by means of fixed bearing supports, said intermediate frame being cantilevered and provided with detachable intermediate pieces for quick replacement of said transfer band loop.

3. The press section of claim 1, wherein said center roll is provided with a smooth cylindrical mantle and said transfer band fabric is a substantially impermeable fabric structure.

4. The press section of claim 1, wherein said center roll is hollow-faced, the press section further comprising cleaning means for cleaning a face of said center roll and collecting means for collecting of water and impurities, said cleaning means and said collecting means located on a sector of said center roll free from said transfer band fabric.

5. The press section of claim 1, wherein the web is transferred from the face of said transfer band fabric onto the drying wire or equivalent in a transfer zone as a closed draw so that, in said transfer zone, the angle of change in the direction of the web is less that about 60°.

6. The press section of claim 5, wherein the angle of change in the direction of the web is from about 2° to about 50°.

7. The press section of claim 5, wherein said transfer suction roll is fitted inside a loop of said drying wire, said transfer suction roll defining said transfer zone, said transfer zone having a magnitude from about 5° to about 20°.

8. The press section of claim 7, further comprising a heater located immediately before said transfer zone by whose means the detaching of the web from said outer face of said transfer band fabric and the transfer of the web as a closed draw onto said drying wire or onto an equivalent transfer fabric are promoted.

9. The press section of claim 8, further comprising a cleaning and/or safety nip defined between a pair of rolls located after said transfer zone and in connection with said transfer band loop, a first one of said pair of rolls in the direction of running of said transfer band fabric being located inside said transfer band loop, and the other one of said pair of rolls being located outside said transfer band loop, and jet and/or doctor means located on a sector of said other of said pair of rolls, said jet and/or doctor means being structured and arranged such that a face of said other roll is kept clean and any web which may run over said face of said other roll to broke, is separated from said face of said other roll.

10. The press section of claim 9, further comprising an additional heating device arranged in connection with said transfer band loop, said additional heating device structured and arranged to improve cleaning of said transfer band loop and dewatering of the web in the nips through which said transfer band fabric runs.

11. The press section of claim 10, wherein said additional heating device is a steam box and/or an infrared heater.

12. The press section of claim 10, wherein the thickness and the resilience of said transfer band fabric are provided so that the length in a machine direction of nip zones in said nips through which said transfer band fabric runs is in the range from about 25 to about 70 mm when the linear loads in said nips through which said transfer band fabric runs are in the range from about 10 kN/m to about 200 kN/m.

13. The press section of claim 8, wherein said suction roll has at least two suction zones in which negative pressure is applied.

14. The press section of claim 13, wherein the negative pressure applied in each of said suction zones is different.

15. The press section of claim 1, wherein another of said press rolls defines a second nip with said center roll, said another press roll being mounted on intermediate frame parts which are attached to a front frame part of said press section by means of horizontal articulated joints, and said press roll which defines said last press nip with said center roll being mounted on other intermediate frame parts which are attached to a rear frame part of said press section by means of horizontal articulated joints, said intermediate frame parts being openable by means of actuators so that a space between said front frame part and said rear frame part is open or quickly openable at a top of said press section, wherein press rolls in said compact combination of rolls placed in the area of said space can be replaced by lifting them substantially straight upwards by means of a crane mounted on a ceiling.

16. The press section of claim 15, wherein said another of said press rolls defining a second nip with said center roll is a press-section roll or a hollow-faced press roll.

17. The press section of claim 1, wherein said conditioning means comprising a conditioning nip defined between a first and second roll arranged after said transfer zone and in connection with said transfer band loop, said transfer band fabric contacting said first roll and being guided around said first roll and through said conditioning nip, said transfer band thereafter continuing in a downward path around said second roll, and a doctor means located on a sector of said second roll which is free from said transfer band fabric, said doctor means structured and arranged to remove debris from a roll face of said second roll.

18. The press section of claim 1, wherein after said center roll, said straight run has a downward inclination of from about 10° to about 50° and the web is deflected in said straight run by said deflecting means and said suction roll at an angle to said transfer band fabric from about 2° to about 50°.

19. The press section of claim 1, further comprising a first press nips being defined between said center roll and a first one of said press rolls, a first fabric passing through said first and said last press nips, said first fabric having an outer face passing around said center roll, the web being carried between said outer face of said first fabric and said outer face of said transfer band through said first press nip and around said center roll to said last press nip, and the web being detached from said first fabric after said last press nip.

20. A closed press section in a paper machine, comprising a compact combination of press rolls defining press nips with each other, one of said press rolls being a center roll, a plurality of fabrics supporting a web, one of said fabrics comprising a transfer band defining a closed loop around said center roll, said transfer band having an outer face upon which the web is transferred, at least a last one of said press nips being defined between said center roll and a first one of said press rolls, a closed loop of said transfer band being passed around said center roll, said transfer band together with a first of said fabrics defining a closed draw located after said last press nip in said compact combination of rolls, the web being constantly supported in said closed draw, said transfer band comprising a fabric which substantially does not receive water and does not rewet the web, said outer face of said transfer band fabric having web-adhesion properties such that, after said last nip, the web follows the transfer band fabric and is transferred in a transfer zone as a fully closed draw onto a drying wire or onto an equivalent fabric that carries the web further into a drying section following said press section, and means for conditioning said transfer band loop, said means structured and arranged to maintain an adequate operation of said transfer band fabric, said means comprising a conditioning nip defined between a first and second roll arranged along a vertical axis and after said transfer zone and in connection with the loop of the transfer band fabric, said transfer band fabric contacting an upper area of said first roll and being guided around said first roll and through said conditioning nip, said transfer band thereafter continuing in a downward path around said second roll, a doctor means located on a sector of said second roll which is free from said transfer band fabric, said doctor means structured and arranged to remove debris from a roll face of said second roll.

* * * * *